US006745578B2

(12) United States Patent
Collins et al.

(10) Patent No.: US 6,745,578 B2
(45) Date of Patent: Jun. 8, 2004

(54) ICE MAKER BAIL ARM RAISING APPARATUS FOR ICE STORAGE BIN

(75) Inventors: Clint J. Collins, North English, IA (US); Jeffrey M. O'Halloran, Cedar Rapids, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/378,152

(22) Filed: Mar. 6, 2003

(65) Prior Publication Data

US 2003/0172664 A1 Sep. 18, 2003

Related U.S. Application Data

(60) Provisional application No. 60/364,106, filed on Mar. 15, 2002.

(51) Int. Cl.[7] ..... F25C 5/18
(52) U.S. Cl. ..... 62/71; 62/137; 62/34
(58) Field of Search ..... 62/71, 137, 344

(56) References Cited

U.S. PATENT DOCUMENTS 2,969,654 A 7/1958 Harle ..... 62/233
3,055,184 A * 9/1962 Linstromberg ..... 62/137
3,744,270 A * 7/1973 Wilcox ..... 62/344
3,911,692 A * 10/1975 Maxwell et al. ..... 62/137
3,926,007 A * 12/1975 Braden et al. ..... 62/137
4,269,039 A * 5/1981 Baker ..... 62/344
4,872,318 A 10/1989 Klemmensen ..... 62/137
5,119,639 A 6/1992 Bein et al. ..... 62/137
6,334,319 B1 1/2002 Senner ..... 62/137

* cited by examiner

*Primary Examiner*—William E. Tapolcai
(74) *Attorney, Agent, or Firm*—Diederiks & Whitelaw, PLC

(57) ABSTRACT

An apparatus for automatically shifting a bail arm of an automatic ice maker upon repositioning an ice storage bin carried by a slidable freezer drawer or basket includes a wedge member arranged just above a rear wall of the bin, preferably between the bin and a rear wall of the basket. The wedge member defines a frontal wedge portion that generally tapers laterally and rearwardly from a wide section to a narrow section. As the bin is shifted out of the freezer compartment, the bail arm initially engages the wide section of the frontal wedge portion, then rides up the frontal wedge portion, and subsequently rides along an opposing, rear wedge portion of the wedge member. This action is reversed upon sliding the bin back into place beneath the ice maker to gently repositioned the bale arm over the ice bin.

20 Claims, 6 Drawing Sheets

ICE MAKER BAIL ARM RAISING APPARATUS FOR ICE STORAGE BIN

CROSS REFERENCE TO RELATED APPLICATION

The present application claims the benefit of Provisional Patent Application Ser. No. 60/364,106 filed Mar. 15, 2002.

BACKGROUND OF THE INVENTION

1. Field of the Invention

The present invention pertains to the art of refrigerators and, more particularly, to an assembly for automatically shifting a bail arm of an automatic ice maker upon repositioning an ice storage bin.

2. Discussion of the Prior Art

In the art of refrigerators, it is widely known to incorporate an automatic ice maker system wherein ice cubes are formed and collected within a storage bin from which the cubes can be accessed either manually or through a dispenser. With such a system, provisions are commonly made to sense the level of ice cubes within the storage bin and to automatically terminate the formation of additional ice cubes until the level falls below a certain height. Typically, the automatic ice maker will have an associated bail arm which is raised and lowered based on the level of the ice in the storage bin. When the bail arm is shifted upward a predetermined distance, the formation of ice will be temporarily terminated. In any event, when it is desired to withdraw the ice storage bin from or subsequently insert the ice bin into the freezer compartment, the bail arm can actually obstruct the movement of the bin.

To address this concern, it has been proposed to enable the bail arm to be raised to and maintained in an upper, non-ice producing position. In this manner, prior to removing the bin, the bail arm need only be manually shifted to this upper position. After the bin is replaced within the freezer, the bail arm can again be lowered to allow the production of more ice. Other arrangements known in the art configure the bin to coact either directly with the bail arm or a sensing member attached to the bail arm in order to at least automatically raise the bail arm upon removal of the bin from the freezer compartment.

Although the prior art discloses ways in which to automatically shift a bail arm of an automatic ice maker out of the way in order to enable an ice storage bin to be slid into and out of a position beneath the ice maker as needed, there still exists a need in the art for an improved bail arm raising apparatus to be used in connection with a slidable ice storage bin. There particularly exists a need for an automatic bail arm raising apparatus used in connection with an ice storage bin that is movably mounted with a pull-out basket or drawer for a refrigerator freezer compartment, wherein the raising apparatus is specifically designed to keep the bail arm above the level of the ice in the bin as the bin is shifted, thereby preventing the bail arm from being dragged through the ice.

SUMMARY OF THE INVENTION

The present invention is directed to an assembly for automatically shifting a bail arm of an automatic ice maker upon repositioning an ice storage bin, particularly an ice storage bin carried by a slidable freezer drawer or basket. In the most preferred form of the invention, a refrigerator includes a cabinet defining an upper fresh food compartment and a lower freezer compartment. The lower freezer compartment is provided with at least one drawer or shelf within which food items can be stored. A portion of the drawer is taken up by a ice storage bin or bucket which is adapted to be positioned beneath an automatic ice maker, provided in the freezer compartment, when a door for the freezer compartment is closed. Most preferably, the drawer is constituted by a wire basket supported upon rails. In any event, additionally provided is a device, which can be attached to or formed integral with either the basket or ice bin, for automatically raising the bail arm out of the way whenever the basket and ice bin is shifted relative to the refrigerator cabinet.

In accordance with a first preferred embodiment of the invention, the bail arm raising apparatus is located to the rear of the ice bin and includes a wedge member arranged just above a rear wall of the bin, preferably between the bin and the back of the basket. The wedge member defines a frontal wedge portion that generally tapers laterally and rearwardly from a wide section to a narrow section. As the bin is shifted out of the freezer compartment, the bail arm of the ice maker initially engages the wide section of the frontal wedge portion and, as the bin is continually pulled farther from the freezer compartment, the bail arm rides up the frontal wedge portion, whereupon the bail arm can rest upon the raising apparatus. As the bin is still further removed, the bail arm is permitted to ride along an opposing, rear wedge portion of the wedge member. This action is reversed upon sliding the bin back into place beneath the ice maker. That is, when the bin is repositioned within the freezer compartment, the bail arm will be caused to ride up the rear wedge portion in order to raise the bail arm to the top storage level for the ice. As the bin continues back into the freezer compartment, the bail arm will first ride along the raising apparatus and then will be guided downward along the frontal wedge portion, thereby being gently repositioned over the ice bin.

In accordance with a second preferred embodiment of the invention, the shape of the bail arm raising apparatus is altered such that the wedge member, in addition to including frontal and rear wedge portions, is provided with an arcuate or curved incline portion. This configuration is considered advantageous when used in connection with an ice maker having a relatively short bail arm as compared to the height of the ice bin. With this arrangement, the bail arm would need to be raised relatively high in order to reach an automatic shut-off position. In accordance with this embodiment, the bail arm will be caused to ride along the incline portion, as well as the frontal and rear wedge portions, upon removing the ice bin from and repositioning the bin into the freezer compartment.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
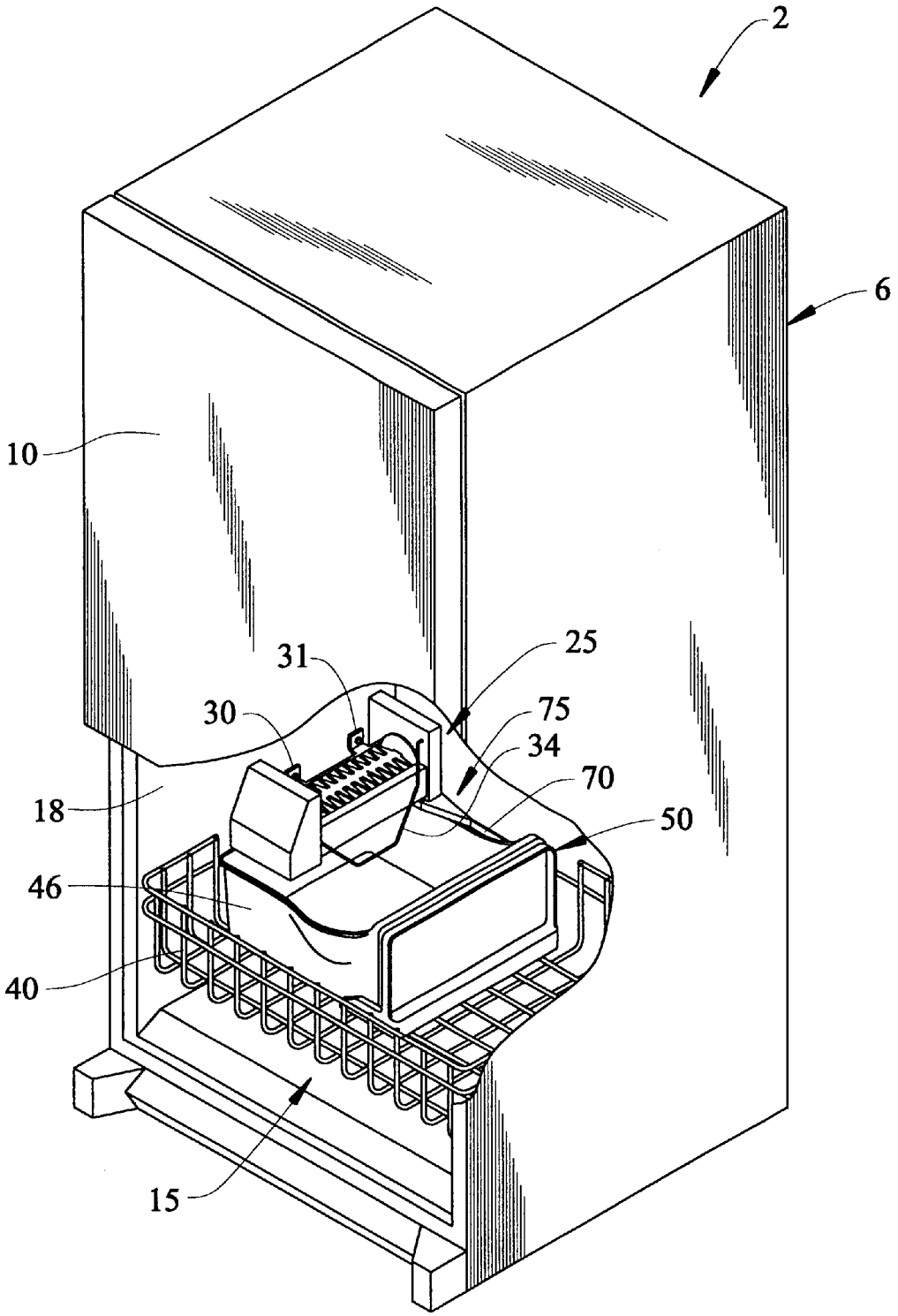
FIG. 1 is a perspective, partially cut-away view of a refrigerator incorporating the ice maker bail arm raising apparatus of the present invention.

With initial reference to FIG. 1, a refrigerator incorporating the bail arm raising apparatus of the present invention is generally indicated at 2. As shown, refrigerator 2 includes a cabinet shell 6 provided with an upper fresh food compartment door 10 which is adapted to close off an upper fresh food compartment (not shown). As known in the art, fresh food door 10 is adapted to pivot about a vertical axis defined by upper and lower hinges (not shown) at a predetermined front side portion of cabinet shell 6. Within cabinet shell 6 is also defined a freezer compartment generally indicated at 15 which is defined by a liner 18. Although not shown, freezer compartment 15 is adapted to be closed off by means of a door. With this general construction, refrigerator 2 defines a bottom mount style unit. As known in the art, the door associated with freezer compartment 15 can either be mounted for a pivotable movement about a vertical axis similar to fresh food door 10, or mounted upon slide assemblies which permit linear shifting of the freezer door towards and away from cabinet shell 6.

As illustrated in this figure, freezer compartment 15 has mounted therein an automatic ice maker 25. In general, the construction and operation of automatic ice maker 25 is widely known in the art and therefore will not be duplicated here. However, in the preferred embodiment, ice maker 25 is fixed against liner 18 at brackets 30 and 31 and includes a bail arm 34. In a manner widely known in the art, bail arm 34 is adapted to be raised and lowered based on a level of ice stored generally beneath automatic ice maker 25 as will be more fully discussed below.

Mounted within freezer compartment 15 is a drawer that preferably takes the form of a basket 40. As shown, basket 40 generally has a meshed wire construction. However, as will become fully evident upon reading the remainder of this description, the drawer can take various forms in accordance with the overall invention. At this point, it is simply important to note that basket 40 can be selectively shifted into and out of freezer compartment 15. Although not depicted in this figure, there may be one or more additional baskets within freezer compartment 15 for the additional storage of food items. In any event, arranged within basket 40 is an ice bin 46. More particularly, ice bin 46 is adapted to be arranged below automatic ice maker 25, at least when drawer 40 is fully retracted within freezer compartment 15. In accordance with the invention, ice bin 46 can take various forms, such as the generally four-sided arrangement depicted in this figure. The present invention is particularly directed to raising apparatus 50 which is adapted to be secured for concurrent movement with both basket 40 and ice bin 46, while functioning to interact with bail arm 34 during such movement as will be detailed below.

Figure 2:
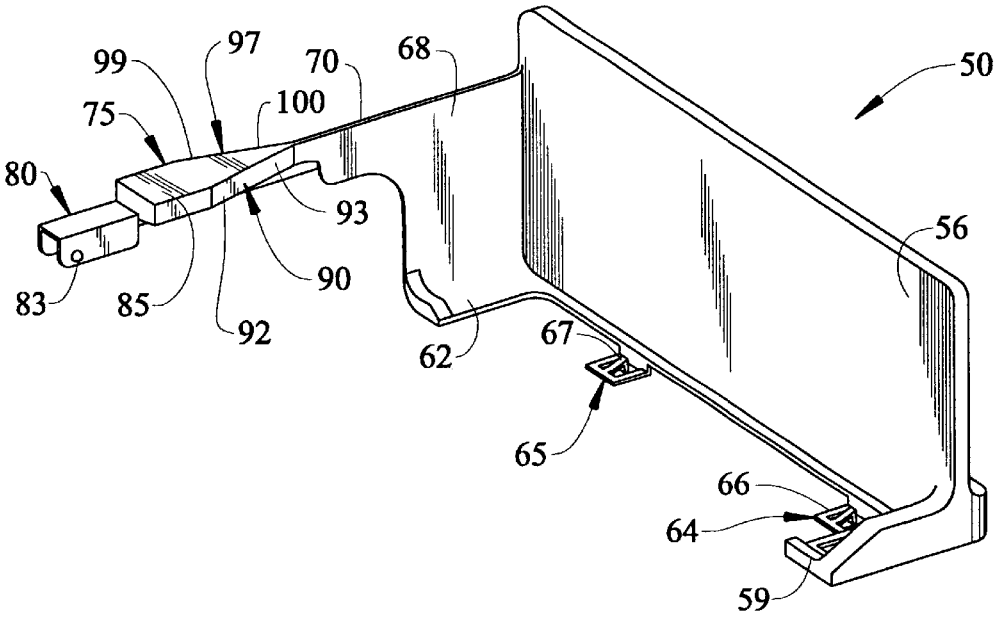
FIG. 2 is a perspective view of an ice maker bail arm raising apparatus constructed in accordance with a first preferred embodiment of the invention.
Figure 3:
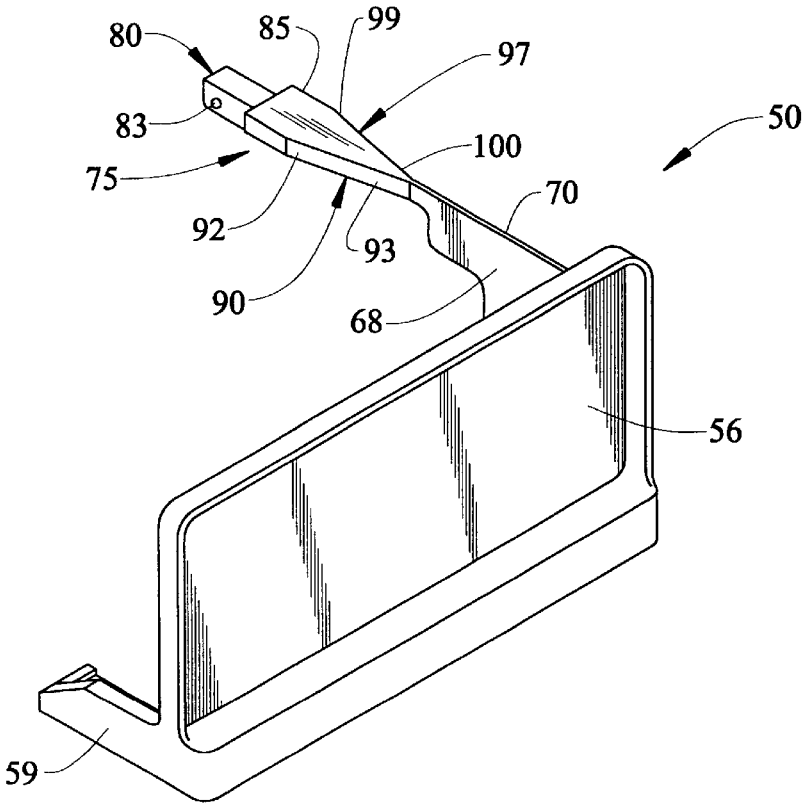
FIG. 3 is another perspective view of the raising apparatus of FIG. 2.

Particular reference will now be made to FIGS. 2 and 3 in describing a first preferred embodiment of raising apparatus 50. As shown in these figures, raising apparatus 50 preferably includes an upstanding wall 56 including a frontal base 59 and a rear base 62. Between frontal base 59 and rear base 62, raising apparatus 50 is provided with a pair of clip units 64 and 65, each including a base pad 66 and a resilient finger member 67. Extending up from rear base 62 is a rear wall 68 having an associated upper edge section 70. Upper edge section 70 leads to a wedge member 75 and then to a terminal mount 80. In the preferred embodiment shown, terminal mount 80 generally takes the form of an elongated, inverted U-shape member and is provided with an associated aperture 83 which is adapted to receive a mechanical fastener, such as a screw (not shown). Wedge member 75 is specifically formed to include a block portion 85 which leads, on one side, to a frontal wedge portion 90 that generally tapers laterally and rearwardly from a wide section 92 to a narrow section 93. Wedge member 75 also includes a rear wedge portion 97 that tapers laterally and forwardly from a wide section 99 to a narrow section 100, in general opposition to frontal wedge portion 90.

Figure 4:
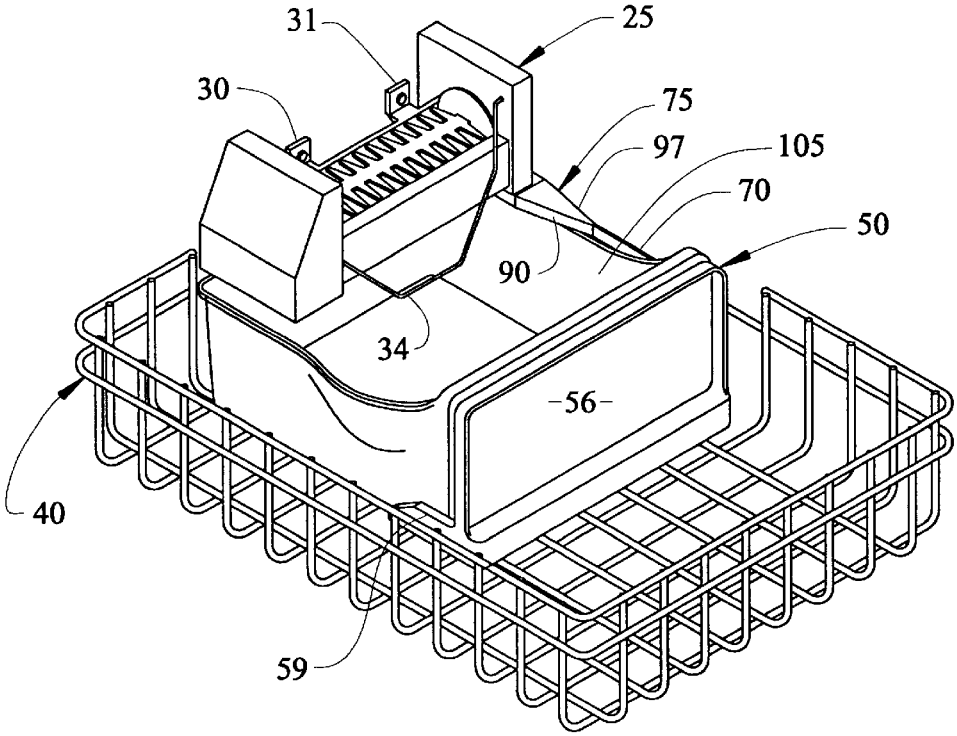
FIG. 4 is a perspective view of the bail arm raising apparatus shown in combination with a freezer basket, ice bin and automatic ice maker.
Figure 5:
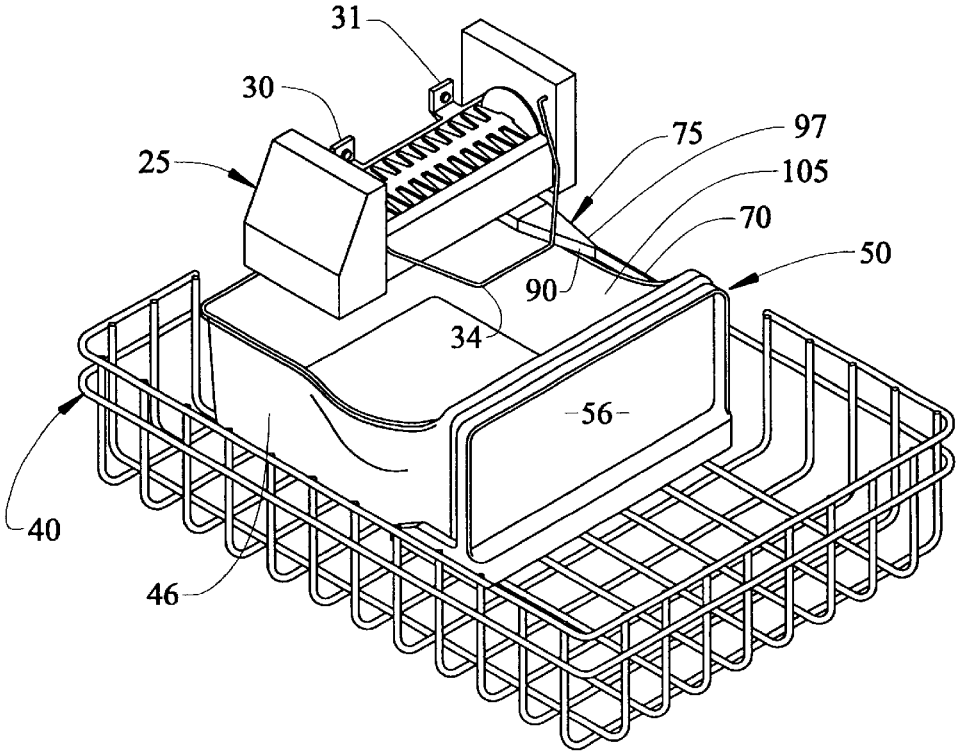
FIG. 5 is a perspective view similar to that of FIG. 4, but depicting the interengagement between the raising apparatus of the invention and the ice maker bail arm upon shifting of the basket relative to the automatic ice maker.
Figure 6:
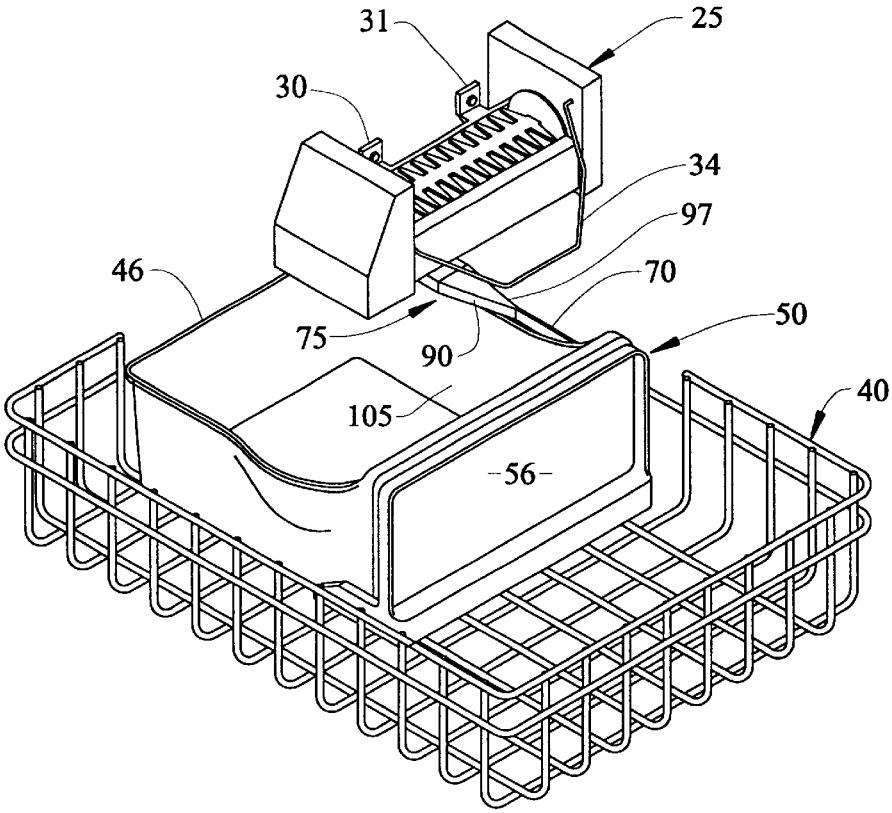
FIG. 6 illustrates a further operational position for the bail arm raising apparatus of the invention.

Raising apparatus 50 is preferably installed within basket 40 with raising apparatus 50 being attached to basket 40 at least at clips 64 and 65 and through terminal mount 80. More specifically, clips 64 and 65 engage one of the wires of basket 40, while terminal mount 80 extends about another wire (not shown) of basket 40, with the wire being retained within terminal mount 80 by the tightening of a mechanical fastener within aperture 83. Ice bin 46 is designed to extend between frontal base 59 and rear base 62 within basket 40 as clearly shown in FIGS. 4–6. At this point, it is important to note that wedge member 75 extends above at least a rear wall 105 of ice bin 46 as also clearly shown in these figures.

With this arrangement, as basket 40 and, correspondingly, ice bin 46, are selectively shifted out of freezer compartment 15, bail arm 34 will be caused to initially engage frontal wedge portion 90 of wedge member 75. More specifically, bail arm 34 will initially engage wide section 92 of frontal wedge portion 90 and, as basket 40 and ice bin 46 are pulled further from freezer compartment 15, bail arm 34 will be caused to ride up frontal wedge portion 90 (see FIG. 5) towards narrow section 93. As basket 40 and ice bin 46 are further removed from freezer compartment 15, bail arm 34 will actually be caused to ride along upper edge section 70. Still further withdrawal of basket 40 and ice bin 46 from freezer compartment 15 will cause bail arm 34 to engage rear wedge portion 97 (see FIG. 6). That is, bail arm 34 will initially engage narrow section 100 and will continue along rear wedge portion 97 towards wide section 99 until basket 40 and ice bin 46 are pulled to a position wherein wedge member 75 is spaced completely forward of bail arm 34.

Based on the interengagement between wedge member 75 and bail arm 34, as basket 40 and ice bin 46 are removed from freezer compartment 15, bail arm 34 will be progressively raised above a top storage level for ice within ice bin 46. This action is reversed upon sliding of basket 40 and ice bin 46 into place beneath ice maker 25. That is, when basket 40 and ice bin 46 are repositioned within freezer compartment 15, bail arm 34 will be caused to ride up rear wedge portion 97 in order to raise bail arm 34 to the top storage level for the ice, as represented by bail arm 34 riding along upper edge section 70. As basket 40 and ice bin 46 continue back into freezer compartment 15, bail arm 34 will continue to ride along upper edge section 70 and then will be guided downward along frontal wedge portion 90, thereby being gently repositioned over ice bin 46.

Figure 7:
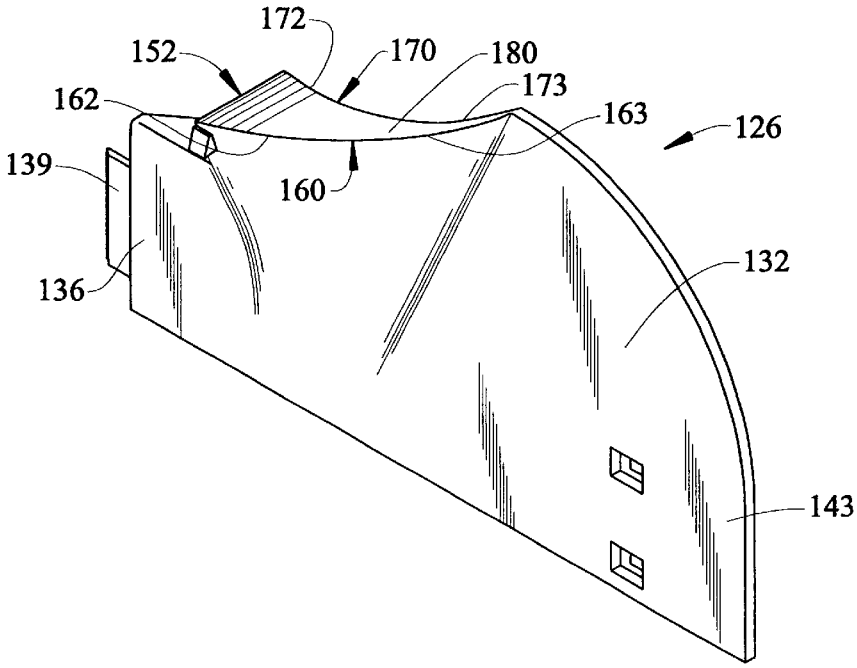
FIG. 7 is a perspective view of a bail arm raising apparatus constructed in accordance with a second embodiment of the invention.
Figure 8:
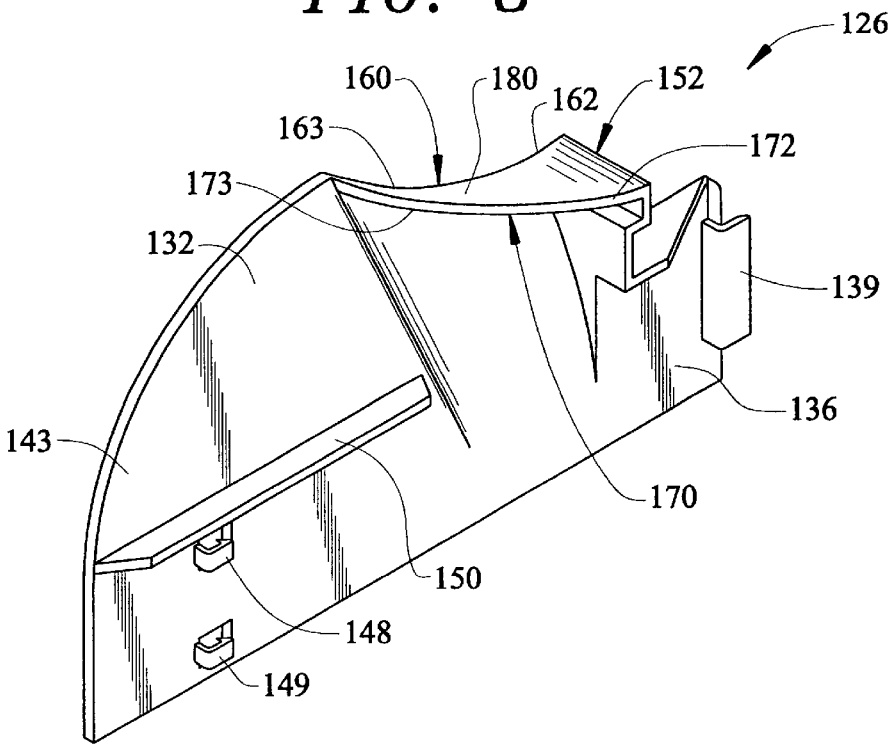
FIG. 8 is another perspective view of the bail arm raising apparatus of FIG. 7.
Figure 9:
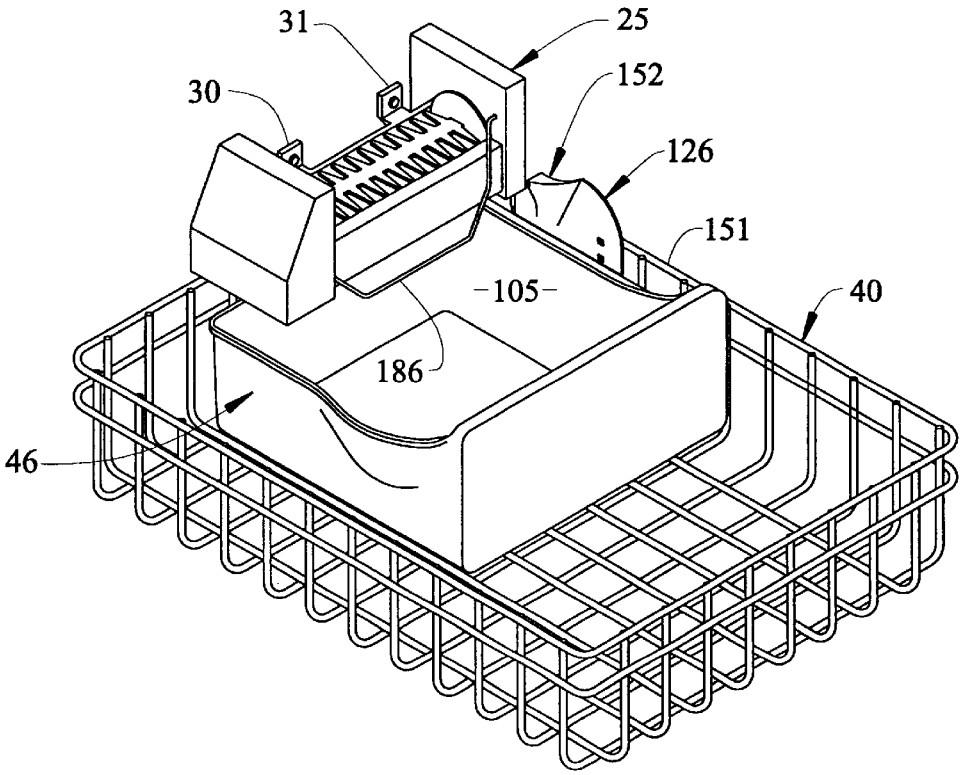
FIG. 9 shows the bail arm raising apparatus of FIGS. 7 and 8 in combination with a freezer basket, ice bin and automatic ice maker.
Figure 10:
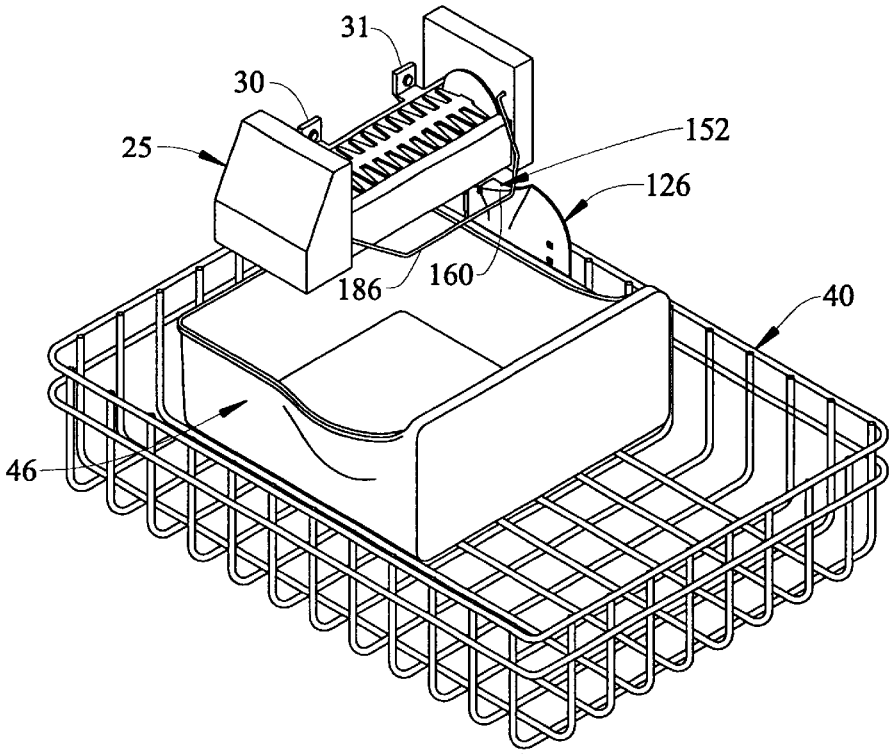
FIG. 10 shows an interengagement between the raising apparatus of FIG. 9 and a bail arm of the automatic ice maker.

FIGS. 7 and 8 depict a raising apparatus 126 constructed in accordance with a second preferred embodiment of the invention. As shown in these figures, raising apparatus 126 includes a body portion 132 that generally takes the form of a plate having a first end 136, formed with an elongated tab member 139, and a second end 143. Adjacent second end 143, body portion 132 is preferably provided with a pair of spaced cantilevered clips 148 and 149, as well as a ledge 150. Elongated tab member 139 and cantilevered clips 148 and 149 enable raising apparatus 126 to be attached to respective wires of basket 40 at a position between a rear of basket 40 and ice bin 46, with ledge 150 preferably resting atop a peripheral rim member or wire 151 of basket 40 (see FIGS. 8–10).

In a manner similar to wedge member 75, raising apparatus 126 is formed with a wedge member 152 having a frontal wedge portion 160 that includes a wide section 162 and a laterally and rearwardly spaced narrow section 163. In addition, wedge member 152 includes a rear wedge portion 170 having a wide section 172 and a narrow section 173. However, unlike raising apparatus 50 which is shown to be provided with an upper edge section 70 that extends substantially horizontal from wedge member 75, raising apparatus 126 is preferably formed with a sloping or inclined surface portion 180 defined between frontal and rear wedge portions 160 and 170.

Figure 11:
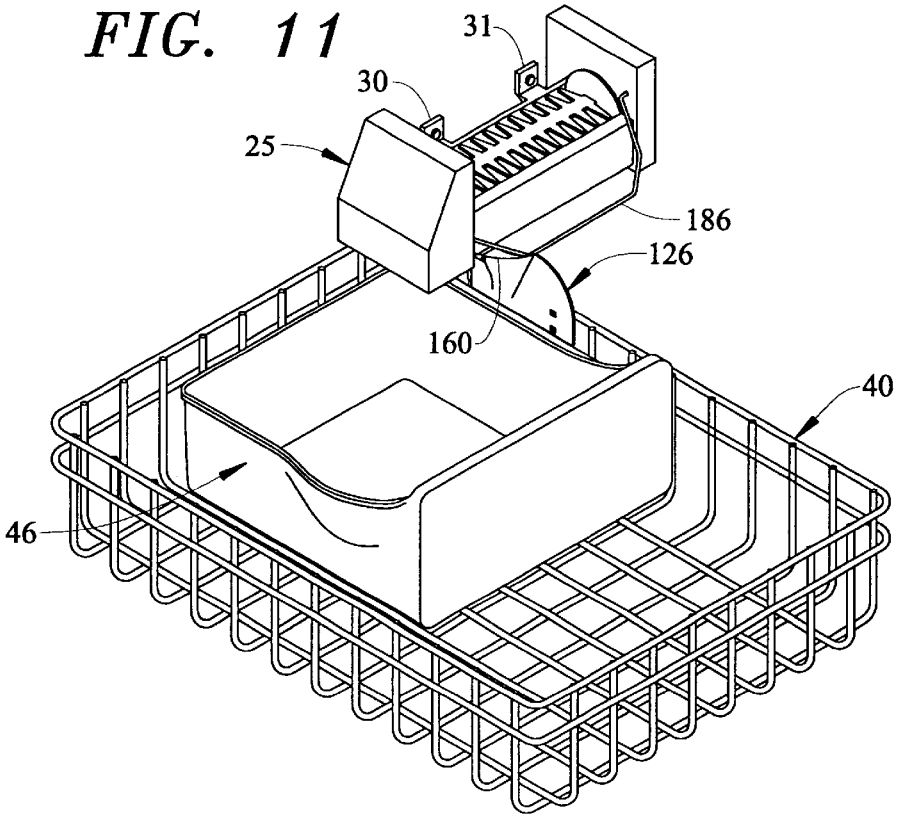
FIG. 11 shows another operational position between the bail arm of the automatic ice maker and the raising apparatus of the invention.

The use of sloping surface portion 180 is considered to be particularly advantageous when used in connection with an automatic ice maker 25 having a relatively short bail arm 186 (see FIG. 9) as compared to the height of ice bin 46. Under these circumstances, bail arm 186 would generally need to be raised relatively high in order to reach an automatic shut-off position. In any event, with this construction, bail arm 186 will be caused to ride along frontal wedge portion 160 (FIGS. 10 and 11) and rear wedge portion 170 upon shifting of basket 40 and ice bin 46 in a manner directly corresponding to that set forth in accordance with the first embodiment described above. However, whenever bail arm 186 is led from wide section 162 to narrow section 163 or from wide section 172 to narrow section 173, bail arm 186 will be caused to ride up the slope defined by portion 180 so as to be raised significant higher. Of course, it should be readily recognized that a similar slope, whether linear or arcuate in nature, could be provided in connection with wedge member 75 and/or upper edge section 70 of the first embodiment.

Based on the above description, it should be readily apparent that the raising apparatus of the present invention is adapted to be used in connection with an ice storage bin that is moveably mounted with a pullout drawer for a refrigerator freezer compartment, and the raising apparatus is specifically designed to keep the bail arm above the level of ice in the bin as the ice bin is shifted, thereby preventing the bail arm from being dragged through the ice. If the raising apparatus of the present invention were not used, either the bail arm would have to be manually shifted upon removal of the drawer and ice bin from the freezer compartment or the bail arm would simply fall off the top of any ice pile existing in the bin and back to a lower default starting location whenever the drawer and ice bin are removed from the freezer compartment. When the drawer and bin were slid back within the freezer compartment, the bail arm would essentially stay in its default starting position and plow through the ice pile in the bin. This can lead to the problem wherein the ice maker believes the ice bin is not filled, such that additional ice harvesting cycles are initiated. Obviously, this would result in an overflow of ice within the bin. The action instigated by the wedge member on the bail arm in accordance with the present invention prevents the unnecessary harvesting of ice and prevents the level of ice in the bin from becoming too high. The inclusion of the wedge member establishes the necessary forces to shift the bail arm vertically as needed. In accordance with at least the second embodiment which incorporates the inclined or sloped wedge member, the inclined surface itself applies forces to the bail arm at an acute angle, thereby aiding and pivoting the bail arm up to the top of its motion. Although this same function could be achieved through a wedge and inclined plane, the curved configuration is preferred as it aids in preventing the bail arm from binding, which makes the force required to deflect the bail arm upon shifting of the drawer and bin less noticeable to the user.

Although described with respect to preferred embodiments of the invention, it should be readily understood that various changes and/or modifications can be made to the invention without departing from the spirit thereof. In accordance with the invention as disclosed, both raising apparatus 50 and 126 are preferably integrally molded of plastic. However, other constructions could be employed, including integrally forming ice bin 46 or basket 40 with the sloping portion and/or a respective wedge member. In any case, the invention is only intended to be limited by the scope of the following claims.

We claim:

1. A refrigerator comprising:

a cabinet defining a fresh food compartment and a freezer compartment;

an automatic ice maker having a bale arm which is movable between raised and lowered positions for controlling a production of ice cubes within the freezer compartment;

a bin, arranged below a level of the automatic ice maker, for collecting ice cubes produced by the automatic ice maker;

a drawer shiftably mounted within the freezer compartment, said bin being positioned in the drawer; and an apparatus for adjusting a height of the bale arm upon shifting of the bin relative to the automatic ice maker, said apparatus including a wedge member which engages the bale arm upon shifting of the drawer relative to the cabinet.

2. The refrigerator according to claim 1, wherein the drawer constitutes a basket having at least a bottom wall and a rear wall, said wedge member being located, at least in part, between the rear wall of the basket and the bin.

3. The refrigerator according to claim 2, wherein the apparatus is attached to the basket along at least the rear wall.

4. The refrigerator according to claim 3, wherein the apparatus is clipped to the bottom wall and both extends over and is connected to the rear wall.

5. The refrigerator according to claim 4, wherein the apparatus includes a terminal mount which is mechanically fastened to the rear wall of the basket.

6. The refrigerator according to claim 4, wherein the apparatus includes an upstanding side wall extending adjacent the bin within the drawer.

7. The refrigerator according to claim 6, wherein the apparatus includes at least one base portion.

8. The refrigerator according to claim 2, wherein the apparatus is clipped to and projects above the rear wall.

9. The refrigerator according to claim 8, wherein the apparatus further includes a tab member interengaged with the basket.

10. The refrigerator according to claim 1, wherein the wedge member includes a frontal wedge portion and an opposing rear wedge portion.

11. The refrigerator according to claim 10, wherein each of the frontal and rear wedge portions taper laterally away from the automatic ice maker so as to define a wide section and a narrow section, with the wide section being located closer to the automatic ice maker than the narrow section.

12. The refrigerator according to claim 11, wherein the frontal and rear wedge portions are interconnected by an upper surface portion of the wedge member, with the upper surface portion extending in a substantially horizontal plane.

13. The refrigerator according to claim 11, wherein the frontal and rear wedge portions are interconnected by an upper surface portion of the wedge member, with the upper surface portion being curvilinear.

14. The refrigerator according to claim 2, wherein the basket has a meshed wire construction.

15. The refrigerator according to claim 1, wherein the freezer compartment is located below the fresh food compartment and the drawer can be selectively shifted into and out of the freezer compartment.

16. The refrigerator according to claim 1, wherein the apparatus is fixed to the drawer and said bin is removably positioned in the drawer.

17. A method of automatically shifting a bail arm of an automatic ice maker upon repositioning an ice storage bin arranged in a shiftable freezer drawer comprising:

initially engaging the bail arm of to automatic ice maker with a wide section of a frontal wedge portion of a wedge member that forms part of an apparatus which moves as the bin is shifted out of the freezer compartment;

causing the bail arm to ride up to a narrow section of the frontal wedge portion as the bin is continually shifted farther out of the freezer compartment; and causing the bail arm to ride along an opposing, rear wedge portion of the wedge member as the bin is further shifted out of the freezer compartment.

18. The method of claim 17, further comprising: after the bail arm rides up the frontal wedge portion, engaging the bail arm with an upper surface of the apparatus.

19. The method of claim 17, wherein, when the bin is repositioned back into the freezer compartment, the bail arm rides up the rear wedge portion to raise the bail arm to an upper ice storage level for the bin.

20. The method of claim 19, wherein, as the bin continues back into the freezer compartment, the bail arm will initially ride along an upper surface of the apparatus and then will be guided downward along the frontal wedge portion, thereby being gently repositioned over the ice bin.

* * * * *